US010203710B2

(12) United States Patent
Bhattad et al.

(10) Patent No.: US 10,203,710 B2
(45) Date of Patent: Feb. 12, 2019

(54) VOLTAGE REGULATOR WITH OUTPUT CAPACITOR MEASUREMENT

(71) Applicant: Dialog Semiconductor (UK) Limited, London (GB)

(72) Inventors: Ambreesh Bhattad, Swindon (GB); Frank Kronmueller, Neudenau (DE); Hande Kurnaz, Kirchheim unter Teck (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/817,920

(22) Filed: Nov. 20, 2017

(65) Prior Publication Data

US 2018/0217623 A1 Aug. 2, 2018

(30) Foreign Application Priority Data

Feb. 2, 2017 (DE) ..... 10 2017 201 705

(51) Int. Cl.
*G05F 1/575* (2006.01)
*G05F 1/595* (2006.01)

(52) U.S. Cl.
CPC ..... *G05F 1/595* (2013.01); *G05F 1/575* (2013.01)

(58) Field of Classification Search
CPC . G05F 1/462; G05F 1/56; G05F 1/575; G05F 1/468; G05F 1/562; G05F 1/565
USPC ..... 323/265, 273, 274, 275, 280
See application file for complete search history.

(56) References Cited

U.S. PATENT DOCUMENTS 6,246,221 B1 * 6/2001 Xi ..... G05F 1/575 323/280
9,575,500 B2 * 2/2017 Kronmueller ..... G05F 1/575
2001/0030530 A1 * 10/2001 Marty ..... G05F 1/565 323/280
2003/0218450 A1 * 11/2003 Bonte ..... G05F 1/575 323/273
2005/0073286 A1 * 4/2005 Ke ..... G05F 1/575 323/280
2005/0225306 A1 * 10/2005 Oddoart ..... G05F 1/575 323/274

(Continued)

OTHER PUBLICATIONS

German Office Action, File No. 10 2017 201 705.8, Applicant: Dialog Semiconductor (UK) Limited, dated Aug. 2, 2017, 8 pgs and English language translation, 10 pgs.

*Primary Examiner* — Adolf Berhane
(74) *Attorney, Agent, or Firm* — Saile Ackerman LLC; Stephen B. Ackerman

(57) ABSTRACT

A voltage regulator which provides an output current at an output voltage at an output node of the voltage regulator, based on an input voltage at an input node of the voltage regulator is described. The voltage regulator has an output amplification stage for deriving the output current at the output node from the input voltage at the input node in dependence of a drive voltage. Furthermore, the voltage regulator has a differential amplification stage to determine the drive voltage in dependence of the output voltage and in dependence of a reference voltage. In addition, the voltage regulator has an adaption unit to determine a capacitance indication of a capacitor value of an output capacitor coupled to the output node of the voltage regulator. The adaption unit also adapts the differential amplification stage in dependence of the capacitance indication.

26 Claims, 7 Drawing Sheets

(56) References Cited

U.S. PATENT DOCUMENTS

| | | | | |
|---|---|---|---|---|
| 2006/0164053 | A1* | 7/2006 | Walter | G05F 1/575 323/282 |
| 2007/0159146 | A1* | 7/2007 | Mandal | G05F 1/575 323/280 |
| 2007/0241730 | A1* | 10/2007 | Dow | G05F 1/575 323/280 |
| 2008/0169795 | A1* | 7/2008 | Wang | G05F 1/575 323/280 |
| 2009/0237048 | A1 | 9/2009 | Hou et al. | |
| 2013/0069608 | A1 | 3/2013 | Gakhar et al. | |
| 2014/0247028 | A1 | 9/2014 | Pons et al. | |
| 2015/0061621 | A1 | 3/2015 | Pons | |
| 2016/0161961 | A1* | 6/2016 | El-Nozahi | G05F 1/56 323/280 |
| 2017/0023429 | A1* | 1/2017 | Straeussnigg | H03M 3/336 |
| 2017/0212542 | A1* | 7/2017 | Bhattad | G05F 1/575 |

* cited by examiner

VOLTAGE REGULATOR WITH OUTPUT CAPACITOR MEASUREMENT

TECHNICAL FIELD

The present document relates to a voltage regulator. In particular, the present document relates to a power efficient voltage regulator usable for a large range of output capacitors.

BACKGROUND

Voltage regulators are frequently used for providing a load current at a stable load voltage to different types of loads (e.g. to the processors of an electronic device). A voltage regulator derives the load current from an input node of the regulator, while regulating the output voltage at the output node of the regulator in accordance to a reference voltage.

Linear regulators may also be referred to as three-terminal regulators. The three main terminals of a linear regulator may be described as (1) input terminal, which is connected to an unregulated input voltage source, (2) output terminal, which provides a regulated output voltage source, and (3) ground. The control circuitry of a linear regulator (also referred to herein as differential amplification unit), which typically includes feedback, compensation and voltage regulation, may comprise one or more amplifiers, a Miller capacitor, a current source. The control circuitry defines the operating conditions and system performance of the linear regulator. The dynamic load performance, the loop stability, and the no-load/light-load internal power consumption (given by the quiescent current $I_Q$ times the input voltage) are examples of operating parameters that are dependent on the setting and/or design of the control circuitry.

A linear regulator is typically used in conjunction with an output capacitor which is external to the linear regulator device and which is typically selected by a system designer for the application that the linear regulator is used for. The fixed control circuitry of a linear regulator is typically designed to suit different output capacitors. However, the performance of a linear regulator (notably the power consumption of a linear regulator) is typically not optimal for the different output capacitors.

SUMMARY

The present document addresses the technical problem of providing a voltage regulator which exhibits optimized power consumption for output capacitors having various different capacitor values. According to an aspect, a regulator (notably a voltage regulator such as a linear dropout regulator) is described. The regulator is configured to provide at an output node of the regulator an output current (referred to herein as $I_{OUT}$) at an output voltage (referred to herein as $V_{OUT}$). The output node of the regulator may be coupled to a load (e.g. to a processor) which is to be operated using the load current. The output current is derived from an input voltage (referred to herein as $V_{IN}$) at an input node of the regulator.

The regulator (notably the voltage regulator) typically comprises an output amplification stage. The output amplification stage may comprise a pass transistor (e.g. a p-type metal oxide semiconductor transistor) for deriving the output current at the output node from the input voltage at the input node of the regulator. The input node may correspond to a source of the pass transistor and the output node may correspond to a drain of the pass transistor. Furthermore, the output amplification stage may comprise a driver stage which is configured to set a gate voltage at a gate of the pass transistor based on a drive voltage. The driver stage may comprise a drive transistor (e.g. an NMOS transistor) having a gate that is coupled to the gate of the pass transistor, having a source that is coupled to the source of the pass transistor, and having a drain that is coupled to the gate of the drive transistor. Hence, the drive transistor and the pass transistor may form a current mirror.

Furthermore, the voltage regulator comprises a differential amplification unit (also referred to as control circuitry) which is configured to determine the drive voltage in dependence of the output voltage and in dependence of a reference voltage. In particular, the differential amplification unit may be configured to determine the drive voltage in dependence of the difference between a feedback voltage (which is proportional to the output voltage) and the reference voltage.

The voltage regulator further comprises an adaption unit which is configured to determine a capacitance indication of a capacitor value of an output capacitor coupled to the output node of the voltage regulator. The output capacitor may be arranged between the output node and ground. The capacitance indication may correspond to or may be equal to the capacitor value of the output capacitor. The adaption unit is further configured to adapt the voltage regulator, notably the differential amplification stage of the voltage regulator, in dependence of the capacitance indication. The capacitance indication may be determined at the start-up phase of a voltage regulator. Furthermore, the adaption of the regulator and/or of the differential amplification stage may be performed during the start-up phase of the voltage regulator. By doing this, the voltage regulator may be adapted automatically to difference types of output capacitors. This allows increasing the application range of the voltage regulator. Furthermore, this allows increasing the power efficiency of the voltage regulator.

The adaption unit may be configured to adapt a quiescent current of the voltage regulator in dependence of the capacitance indication. The quiescent current of a voltage regulator typically corresponds to a difference between the input current at the input node of the voltage regulator and the output current at the output node of the voltage regulator. Alternatively or in addition, the quiescent current corresponds to the input current to the voltage regulator, when no output current is provided at the output node of the voltage regulator. Hence, the quiescent current may be indicative of internal losses of the voltage regulator. The adaption unit may be configured to adapt the regulator (notably the differential amplification unit) such that the quiescent current is reduced, if an output capacitor having an increased capacitor value is detected. On the other hand, the adaption unit may be configured to adapt the regulator (notably the differential amplification unit) such that the quiescent current is increased, if an output capacitor having a reduced capacitor value is detected. By doing this, the voltage regulator may be used in a power efficient manner with a wide range of output capacitors.

The voltage regulator, notably the differential amplification stage, may comprise one or more adjustable components affecting the bandwidth and/or the loop speed of the linear regulator. In other words, by adjusting the one or more components, the bandwidth and/or the loop speed of the linear regulator may be adjusted. The adaption unit may be configured to adjust the one or more adjustable components in dependence of the capacitance indication, thereby enabling a power efficient and stable operation of the voltage regulator for a wide range of output capacitors. In particular, the adaption unit may be configured to increase the bandwidth of the voltage regulator, if the capacitance indication indicates a reduction of the capacitor value of the output capacitor. Alternatively or in addition, the adaption unit may be configured to decrease the bandwidth of the voltage regulator, if the capacitance indication indicates an increase of the capacitor value of the output capacitor.

The differential amplification stage may comprise a Miller capacitor with an adjustable capacitance. In particular, the differential amplification stage may comprise a first amplification stage configured to determine an intermediate voltage at an intermediate node in dependence of the output voltage and in dependence of the reference voltage. Furthermore, the differential amplification stage may comprise a second amplification stage configured to determine the drive voltage based on the intermediate voltage. The Miller capacitor may couple the output node to the intermediate node. The adaption unit may be configured to adjust the capacitance of the Miller capacitor in dependence of the capacitance indication. In particular, the capacitance of the Miller capacitor may be decreased, if the capacitor value of the output capacitor decreased. Furthermore, the capacitance of the Miller capacitor may be increased, if the capacitor value of the output capacitor increases. The modification of the capacitance of the Miller capacitor may be dependent on the upper and/or lower load current. By doing this, a power efficient and stable operation of the voltage regulator for a wide range of output capacitors may be provided.

The voltage regulator may comprise a current source which is configured to provide a (regulated) output current at a first output current value to the output node. Furthermore, the voltage regulator may comprise voltage sensing means which are configured to sense a voltage indication of a voltage across the output capacitor (which typically corresponds to the output voltage of the voltage regulator). The adaption unit may be configured to determine the capacitance indication (notably the capacitor value of the output capacitor) based on the first output current value and/or based on the voltage indication.

The adaption unit may be configured to determine, based on the voltage indication, a first duration required for charging the output capacitor from an initial voltage V1 to a target voltage V2 using the output current at the first output current value. The capacitance indication (notably the capacitor value of the output capacitor) may then be determined (also) based on the first duration, thereby providing a precise capacitance indication.

The initial voltage V1 and/or the target voltage V2 may be dependent on the reference voltage. In particular, during operation, the output voltage of the linear regulator may be regulated to a setpoint voltage, which is dependent on the reference voltage. The initial voltage V1 and/or the target voltage V2 may lie within a pre-determined range around the setpoint voltage, wherein the pre-determined range may be 30% or less below to 30% or less above the setpoint voltage. As such, the voltage interval used for determining the first duration may be in the vicinity of the setpoint voltage, which is used during operation of the voltage regulator. By doing this, voltage-dependent components of the capacitor value of the output capacitor may be taken into account, thereby further increasing the power efficiency and stability of the voltage regulator.

The voltage regulator may comprise a discharge circuit which is configured to discharge the output capacitor. The adaption unit may be configured to instruct the discharge circuit to discharge the output capacitor (e.g. to the initial voltage V1), subject to the output capacitor being charged to the target voltage V2, thereby preparing the voltage regulator for an additional measurement.

In the context of an additional measurement, the adaption unit may be configured to control the current source to provide a (regulated) output current at a second output current value to the output node, wherein the second output current value is different from the first output current value (e.g. higher than the first output current value). Furthermore, the adaption unit may be configured to determine, based on the voltage indication, a second duration required for charging the output capacitor from the initial voltage V1 to the target voltage V2 using the output current at the second output current value. The capacitance indication may then be determined (also) based on the second output current value and based on the second duration. By using at least two duration measurements at at least two different output current values, load dependencies may be removed, thereby providing precise capacitance indications.

In particular, the adaption unit may be configured to determine the capacitance indication based on (IOUT2−IOUT1)/(V2−V1)*[(D1*D2)/(D1−D2)]. In particular, the capacitor value of the output capacitor may be determined using the above mentioned formula. In the above mentioned formula: IOUT1 is the first output current value; IOUT2 is the second output current value; D1 is the first duration (see FIG. 6); and D2 is the second duration (see FIG. 6).

Alternatively or in addition, the adaption unit may be configured to adapt a gain of the voltage regulator to cause an oscillation of the output voltage of the voltage regulator. Furthermore, the adaption unit may be configured to determine a frequency indication of a frequency of the oscillation. The capacitance indication may then be determined in a precise manner based on the frequency indication (e.g. using an analytical formula and/or a look-up table, which are dependent on the design and/or the parameters of the voltage regulator).

The voltage regulator may comprise a comparator which is configured to generate a binary signal based on a comparison of the oscillating output voltage and based on a threshold voltage Vt (wherein the threshold voltage may correspond to a mean value of the output voltage). The adaption unit may then be configured to determine the frequency indication based on the binary signal, thereby enabling digital processing in an efficient manner.

According to a further aspect, a method for operating a voltage regulator is described. The voltage regulator is configured to provide an output current at an output voltage at an output node of the voltage regulator, based on an input voltage at an input node of the voltage regulator. The voltage regulator comprises an output amplification stage for deriving the output current at the output node from the input voltage at the input node in dependence of a drive voltage. Furthermore, the voltage regulator comprises a differential amplification stage configured to determine the drive voltage in dependence of the output voltage and in dependence of a reference voltage. The method comprises determining a capacitance indication of a capacitor value of an output capacitor coupled to the output node of the voltage regulator. Furthermore, the method comprises adapting the differential amplification stage in dependence of the capacitance indication.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
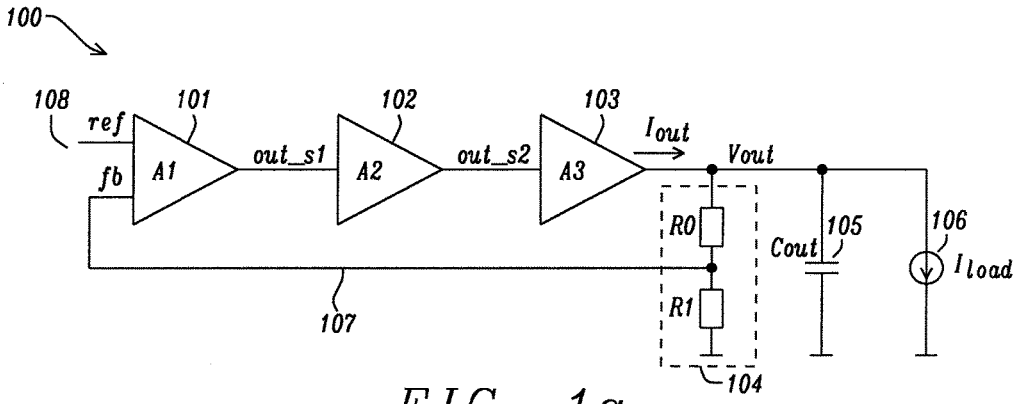
FIG. 1*a* illustrates an example block diagram of an LDO regulator.

As outlined above, the present document is directed at providing a power efficient and stable voltage regulator for different output capacitor values. An example of a voltage regulator is an LDO regulator. A typical LDO regulator 100 is illustrated in FIG. 1*a*. The LDO regulator 100 comprises an output amplification stage or output stage 103, comprising e.g. a field-effect transistor (FET), at the output and a differential or first amplification stage 101 (also referred to as error amplifier) at the input. A first input (fb) 107 of the differential amplification stage 101 receives a fraction of the output voltage $V_{OUT}$ determined by the voltage divider 104 comprising resistors R0 and R1. The second input (ref) to the differential amplification stage 101 is a stable voltage reference $V_{ref}$ 108 (also referred to as the bandgap reference). If the output voltage $V_{OUT}$ changes relative to the reference voltage $V_{ref}$ (or to a setpoint voltage proportional to the reference voltage), the drive voltage to the output amplification stage, e.g. to the power FET, changes by a feedback mechanism called main feedback loop to maintain a constant output voltage $V_{OUT}$.

The LDO regulator 100 of FIG. 1*a* further comprises an additional intermediate amplification stage 102 configured to amplify the output voltage of the differential amplification stage 101. An intermediate amplification stage 102 may be used to provide an additional gain within the amplification path. Furthermore, the intermediate amplification stage 102 may provide a phase inversion.

In addition, the LDO regulator 100 is typically used in conjunction with an output capacitance $C_{out}$ (also referred to as output capacitor or stabilization capacitor or bybass capacitor) 105 parallel to the load 106. The output capacitor 105 is used to stabilize the output voltage $V_{OUT}$ subject to a change of the load 106, in particular subject to a change of the requested load current or output current $I_{load}/I_{OUT}$. The capacitor value or capacitance of the output capacitor 105 may be selected depending on the application.

Figure 1B:
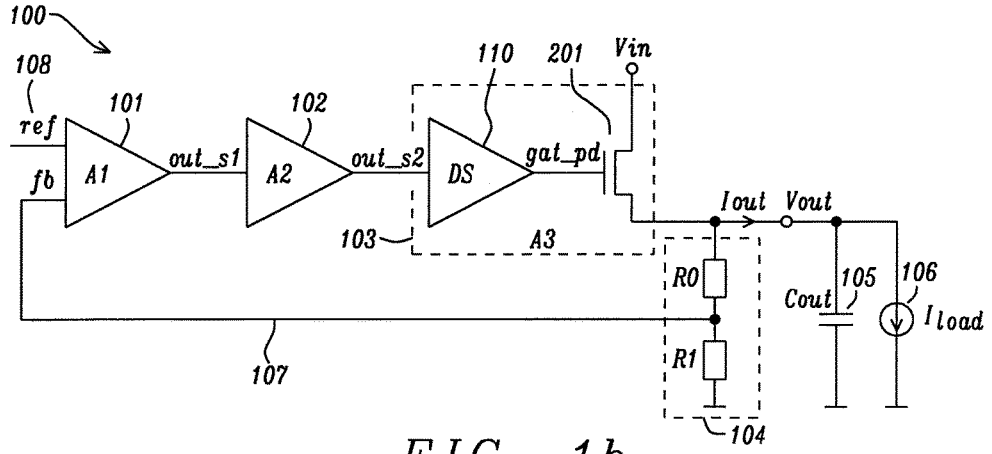
FIG. 1*b* illustrates the example block diagram of an LDO regulator in more detail.

FIG. 1*b* illustrates the block diagram of a LDO regulator 100, wherein the output amplification stage 103 is depicted in more detail. In particular, the pass transistor or pass device 201 and the driver stage 110 of the output amplification stage 103 are shown. Typical parameters of an LDO regulator 100 are a supply voltage of 3V, an output voltage of 2V, and an output current or load current ranging from 1 mA to 100 or 200 mA. Other configurations are possible.

Figure 1C:
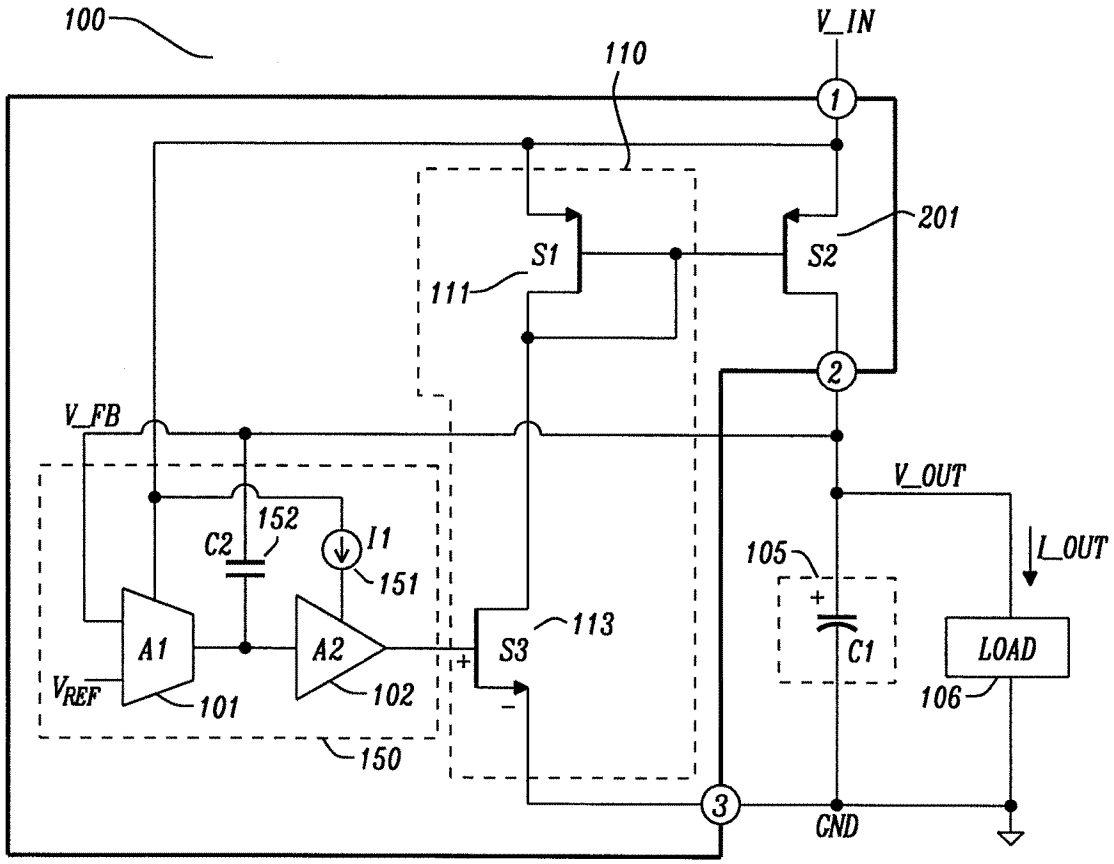
FIG. 1*c* shows another block diagram of an LDO regulator.

FIG. 1*c* shows further details of the driver stage 110. The driver stage 110 comprises a drive transistor 111 (e.g. a p-type metal oxide semiconductor, PMOS, transistor) which is operated as a diode (i.e. the drain of the drive transistor 111 is coupled to the gate of the drive transistor 111). The gate of the drive transistor 111 is coupled to the gate of the pass transistor 201. Furthermore, the source of the drive transistor 111 is coupled to the source of the pass transistor 201, which corresponds to the input node of the regulator 100 (depicted by the encircled "1"). The drain of the pass transistor 201 corresponds to the output node of the regulator 100 (depicted by the encircled "2"). The drive transistor 111 and the pass transistor 201 form a current mirror having a certain gain.

The driver stage 110 further comprises an input transistor 113 (e.g. an n-type MOS or NMOS transistor) which is arranged in series with the drive transistor 111, such that the current through the drive transistor 111 corresponds to the current through the input transistor 113. The serial arrangement of the drive transistor 111 and the input transistor 113 may be arranged between the input node and ground GND (depicted by the encircled "3"). The gate of the input transistor 113 is controlled by the output of the differential amplification unit 150 (which comprises e.g. the differential amplification stage 101 and the intermediate amplification stage 102, a Miller capacitor C2 152 and/or an internal current source I1 151). The voltage at the output of the differential amplification unit 150 is referred to herein as the drive voltage.

FIG. 1*c* also illustrates different terminals of the regulator 100, notably an input terminal or input node (denominated as "1" in FIG. 1*c*) which is coupled to an unregulated input voltage $V_{IN}$, an output terminal or output node (denominated as "2" in FIG. 1*c*) which provides the regulated output voltage $V_{OUT}$ and a ground terminal (denominated as "3" in FIG. 1*c*) which is coupled to ground GND.

A linear regulator 100, notably the differential amplification unit 150 (also referred to herein as control circuitry), is typically designed for the use in conjunction with output capacitors 105 having a certain range of capacitor values.

Figure 1D:
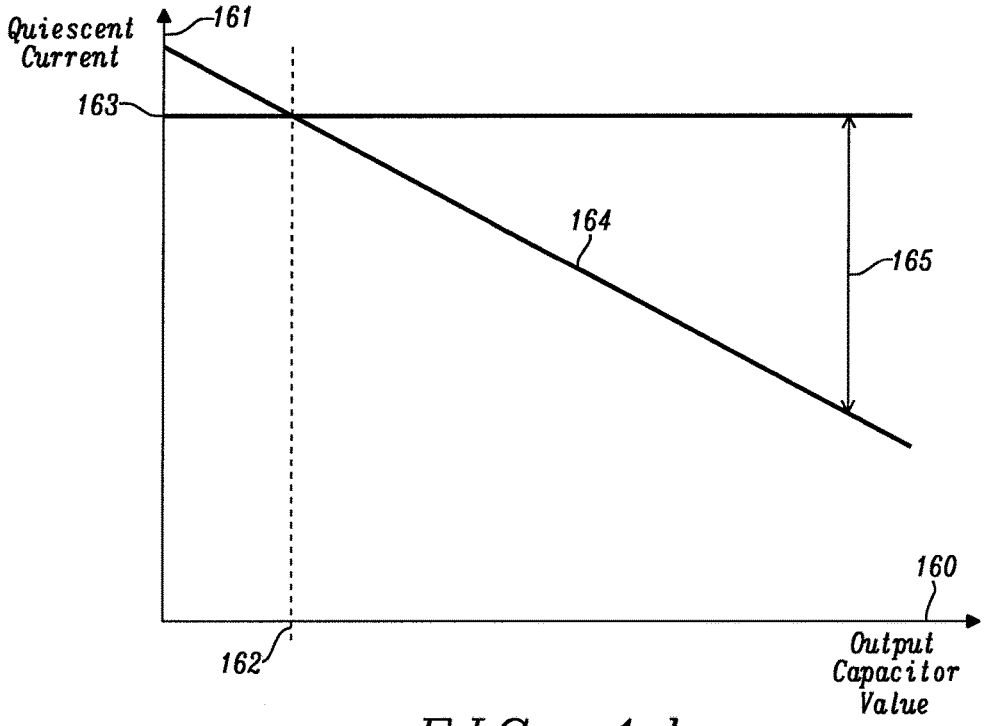
FIG. 1*d* shows example quiescent currents for different output capacitor values.

FIG. 1*d* shows the quiescent current 161 of the regulator 100 of FIG. 1*c* as a function of the output capacitor value 160. The regulator 100 of FIG. 1*c* is typically designed such that the regulator 100 exhibits a fixed quiescent current 163 for different output capacitor values 160. As a result of this, the regulator 100 may be used with output capacitors 105 having the design capacitor value 162 or greater. On the other hand, the regulator 100 may not be used in a stable manner with output capacitors 105 having a capacitor value 160 smaller than the design capacitor value 162.

FIG. 1*d* further shows a curve 164 which indicates the required quiescent current 161 as a function of the size 160 of the output capacitor. It can be seen that as the value 160 of the external output capacitor is increased, the required quiescent current 161 decreases. However, since the control and compensation circuitry 150 of the regulator 100 is fixed to provide a fixed quiescent current 163, the quiescent current 163 is typically too high compared to the required quiescent current 164. Hence, a fixed quiescent current 163 results in internal losses, if the actual output capacitor value 160 is higher than the value 162. These losses result from the difference 165 of the required quiescent current 164 and the pre-fixed quiescent current 163 (times the input voltage).

Figure 2:
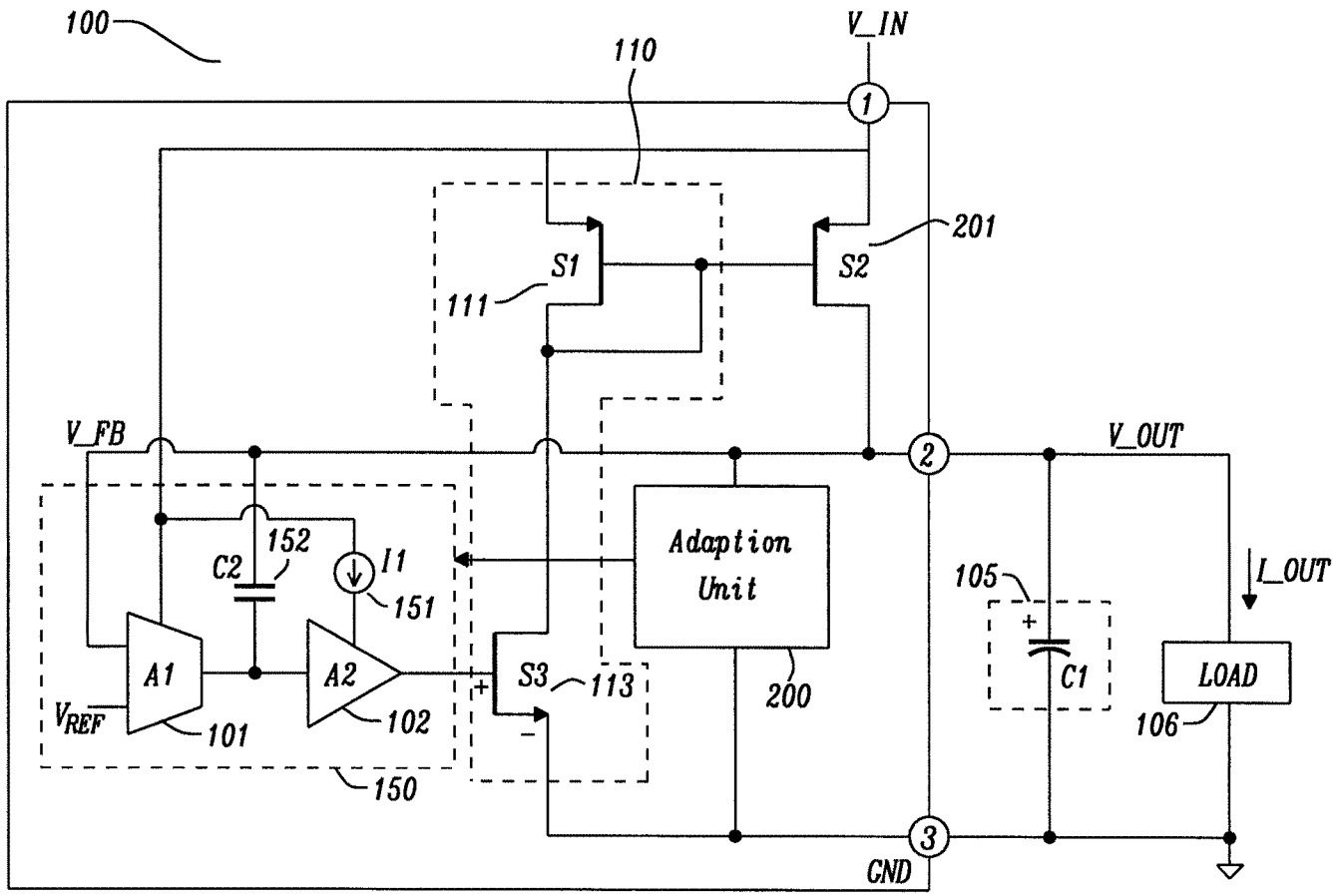
FIG. 2 shows an example LDO regulator with an adaption unit for adapting the operation of the LDO regulator to the output capacitor value.

In order to reduce or remove the above mentioned internal losses, the regulator 100 may comprise an adaption unit 200 (as illustrated in FIG. 2), which is configured to measure the capacitor value 160 of the output capacitor 105, e.g. upon start-up of the regulator 100. Furthermore, the adaption unit 200 may be configured to adapt the control and compensation circuitry 150, notably the internal Miller capacitor 152, in dependence of the measured output capacitor value 160.

Figure 3:
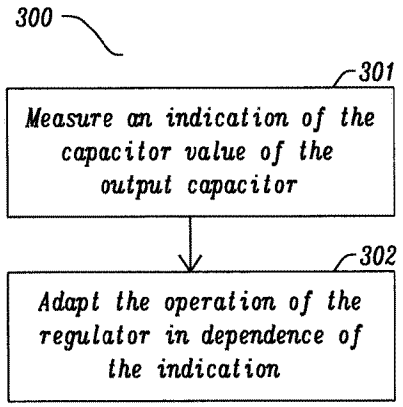
FIG. 3 shows a flow chart of an example method for operating a regulator.

FIG. 3 shows a flow chart of an example method 300 for operating a voltage regulator 100. The voltage regulator 100 is configured to provide an output current at an output voltage at the output node of the voltage regulator 100, based on an input voltage at the input node of the voltage regulator 100. The voltage regulator 100 comprises an output amplification stage 103 for deriving the output current at the output node from the input voltage at the input node in dependence of a drive voltage. Furthermore, the voltage regulator 100 comprises a differential amplification stage (or control circuitry) 150 configured to determine the drive voltage in dependence of the output voltage and in dependence of a reference voltage 108.

The method 300 comprises determining 301 a capacitance indication of a capacitor value 160 of an output capacitor 105 coupled to the output node of the voltage regulator 100. Furthermore, the method 300 comprises adapting 302 the differential amplification stage 150 in dependence of the capacitance indication.

As indicated above, the adaption unit 200 (notably an output capacitor detection block of the adaption unit 200) automatically measures the value 160 of the output capacitor 105 that is coupled to the linear regulator 100. Secondly, having determined the output filter value 160, control and compensation parameters of the linear regulator 100 may be adaptively adjusted, resulting in an optimized performance of the regulator 100.

Figure 4:
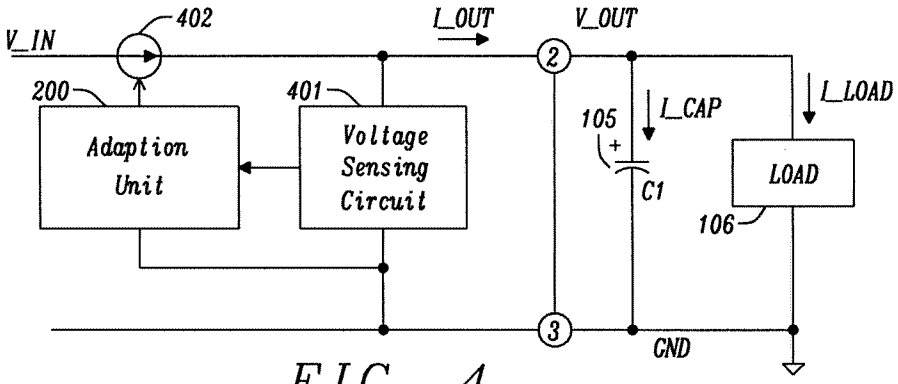
FIG. 4 shows an example adaption unit.

The measurement of the output capacitor value 160 may be accomplished in various different ways. FIG. 4 illustrates a non-limiting example block diagram which includes a programmable current source 402 and a voltage sensing circuit 401 coupled to the output node of the linear regulator 100. The adaption unit 200 (notably an output capacitor measurement controller) may be used to determine the capacitor value 160 of the external output capacitor 105.

A regulated output current (IOUT or I_OUT) may be applied to the output node (using the current source 402), wherein the output current is used (at least partially) to charge the output capacitor 105. The rise time of the voltage across the output capacitor 105 may be measured (using the voltage sensing circuit 401). The value 160 of the output capacitor 105 may then be determined based on the rise time of the capacitor voltage across the output capacitor 105 (which typically corresponds to the output voltage of the output capacitor 105).

However, an accurate measurement of the value 160 of the output capacitor 105 typically depends on knowledge regarding the value of the capacitor charging current (I_CAP) used for charging the output capacitor 105. If the load current I_LOAD for the load 106 is not known, the measurement of the value 160 of the output capacitor 105 based on the output current IOUT is typically inaccurate.

Figure 5:
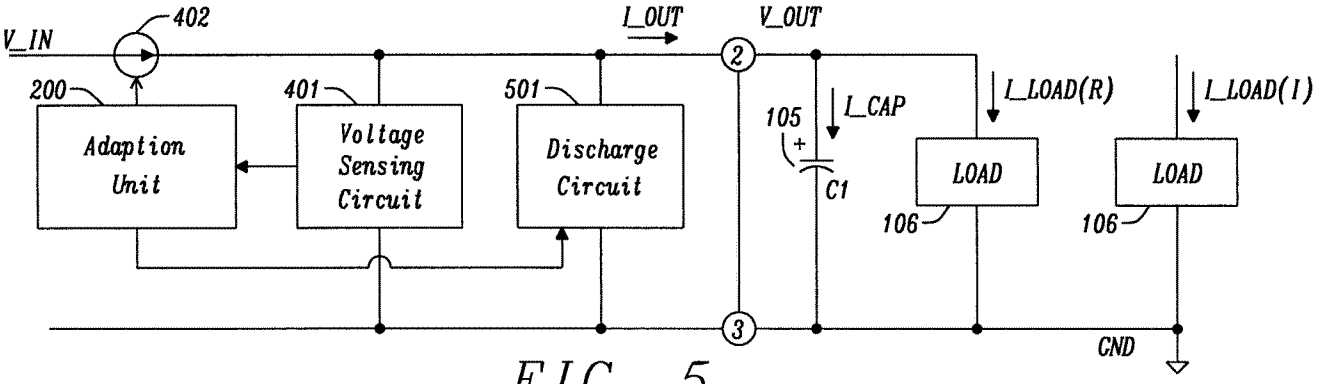
FIG. 5 shows another example adaption unit.
Figure 6:
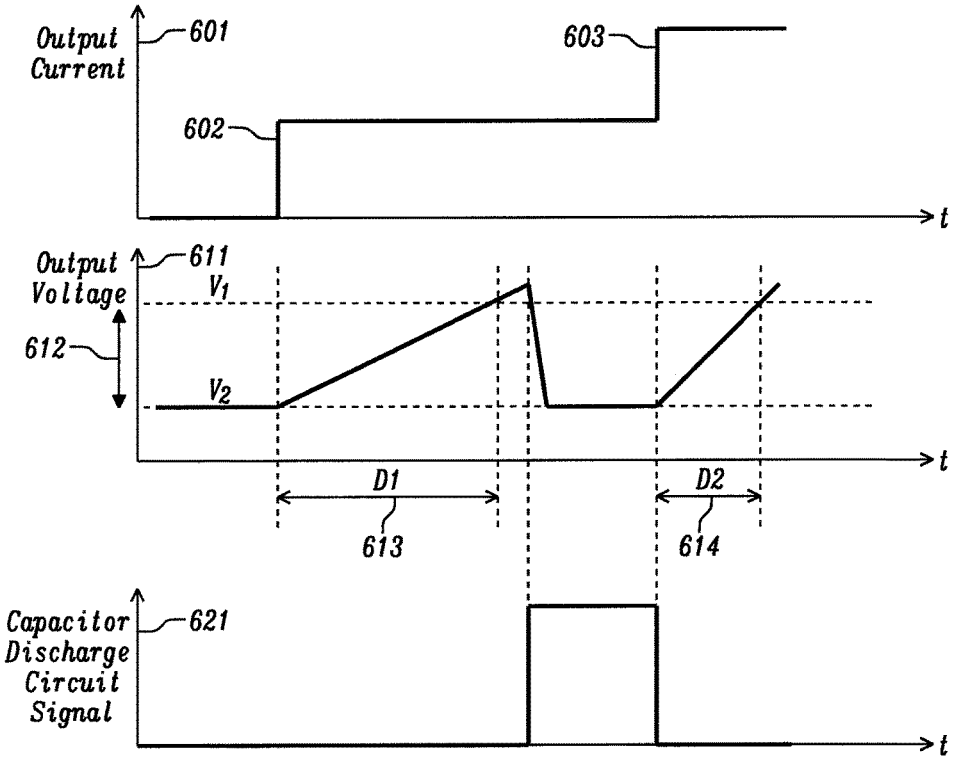
FIG. 6 shows example measurement signals for determining the capacitor value of an output capacitor.

FIG. 5 and FIG. 6 illustrate example means for measuring the value 160 of the output capacitor 105, wherein the means for measuring the value 160 incorporate compensation means for any type of load current that may be present (e.g. a constant load current I_LOAD(I) and a voltage dependent load current I_LOAD(R)), in order to provide an accurate measurement of the value 160 of the output capacitor 105.

FIG. 5 shows the measurement controller of an adaption unit 200, which controls the current source 402 to provide a regulated current (IOUT) at the output terminal. Furthermore, the regulator 100 comprises voltage sense detection means 401 for measuring the voltage at the output terminal (VOUT), corresponding to the voltage across the output capacitor 105. The regulator 100 further comprises a discharge circuit 501 configured to discharge the energy stored in the output capacitor 105. The energy may be discharged e.g. using a discharge resistor coupled across the output capacitor 105.

The output current IOUT or I_OUT provides for a charging current I_CAP for charging the output capacitor 105 and for a load current I_LOAD. The load current may comprise a fixed resistive load current I_LOAD(R) and a constant load current I_LOAD(I).

FIG. 6 illustrates waveforms used to accurately measure the value 160 of the output capacitor 105. The regulated output current source 402 may be configured to provide two or more different regulated output current values 602, 603. The voltage 611 at the output terminal, corresponding to the voltage across the output capacitor 105, may be monitored. The value 160 of the output capacitor 105 may be determined based on the rising rates of the voltage 611 for the different output current values 602, 603.

The first waveform shows the output current 601 provided by the output current source 402 as a function of time t. During a first time interval a first output current 602 (e.g. I_OUT_LOW or IOUT1) and during a second time interval a second output current 603 (e.g. I_OUT_HIGH or IOUT2) is provided to the output terminal. The regulated current source 402 sets the output current 601 to the first output current 602, with the output voltage 611 being at an initial voltage V1 (e.g. V1=0V at start-up or a voltage level close to the setpoint voltage of the linear regulator 100). The voltage 611 at the output terminal is monitored and a first duration 613 (D1) is measured, which corresponds to the time it takes for the output voltage 611 to rise from the initial voltage V1 to a pre-determined output voltage threshold or target voltage V2, with the charge voltage 612 being the difference between V1 and V2. Shortly after the voltage 611 at the output terminal reaches V2, the capacitor discharge circuit 501 is enabled (signal 621) in order to reset the voltage 611 at the output terminal to 0V or the initial voltage V1.

The capacitor discharge circuit 501 is disabled with the current source 402 being set to the second output current 603. The voltage 611 at output terminal is monitored, and a second duration 614 (D2) is measured, which corresponds to the time it takes for the output voltage 611 to rise from the initial voltage V1 to the pre-determined output voltage threshold or target voltage V2.

Based on the measurements shown in FIG. 6, the output capacitor value 160 may be determined as follows:

Using the following notation:

COUT: Output capacitor value (μF)

IOUT: Regulated output current 601 (A)

IOUT_LOW: first output current 602 (A)

IOUT_HIGH: second output current 603 (A)

ILOAD: Load current (A)

ICAP: Capacitor charging current (A)

VCHARGE: Charge voltage 612 tCHARGE_LOW or D1: first duration 613
tCHARGE_HIGH or D2: second duration 614

$$IOUT=ILOAD+ICAP$$

$$IOUT=ILOAD+[COUT*(dv/dt)]$$

Thus:

$$IOUT_LOW=ILOAD+[COUT*(VCHARGE/tCHARGE_LOW)]$$

$$IOUT_HIGH=ILOAD+[COUT*(VCHARGE/tCHARGE_HIGH)]$$

$$IOUT_HIGH-IOUT_LOW=\Delta IOUT=COUT*[(VCHARGE/tCHARGE_HIGH)-(VCHARGE/tCHARGE_LOW)]$$

$$COUT=\Delta IOUT/VCHARGE*[(tCHARGE_LOW*tCHARGE_HIGH)/(tCHARGE_LOW-tCHARGE_HIGH)]$$

Hence, the value 160 of the output capacitor 105, i.e. COUT, may be determined in a precise manner, regardless the value of the load 106.

Once the value 160 of the external output capacitor 105 has been determined, one or more control and compensation parameters of the control circuitry 150 may be optimized. This may include actions for optimizing the dynamic load response of the regulator 100, for compensating loop stability and/or for adapting the no-load quiescent current (thereby optimizing the internal power consumption).

Figure 7:
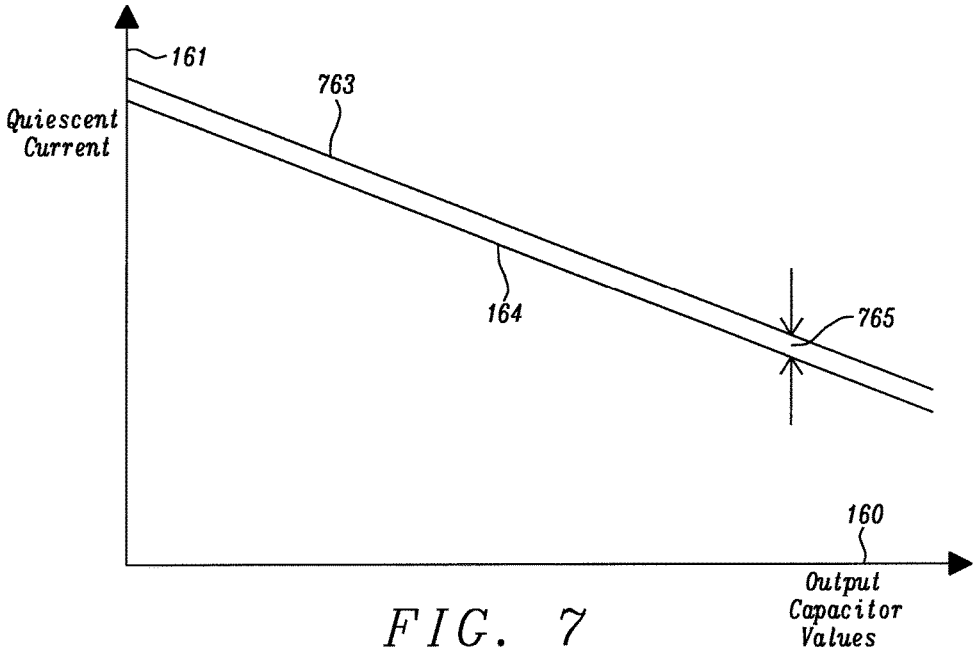
FIG. 7 shows example quiescent currents for different output capacitor values.

By way of example in FIG. 7, the control circuitry 150 may be adapted such that the actual quiescent current 763 of the regulator 100 changes with the value 160 of the output capacitor 105, such that the actual quiescent current 763 exceeds the required quiescent current 164 only by a relatively small guard band 765 (for different values 160 of the output capacitor 105). By doing this, the internal power dissipation of the regulator 100 may be reduced. Due to the fact that a measurement of the external output capacitor 105 is provided, the quiescent current 161 can be adjusted to maintain a proper operation of the regulator 100 (e.g. loop stability) and to minimize internal power consumption. Furthermore, the supported range of output capacitor values 160 may be increased.

Figure 8:
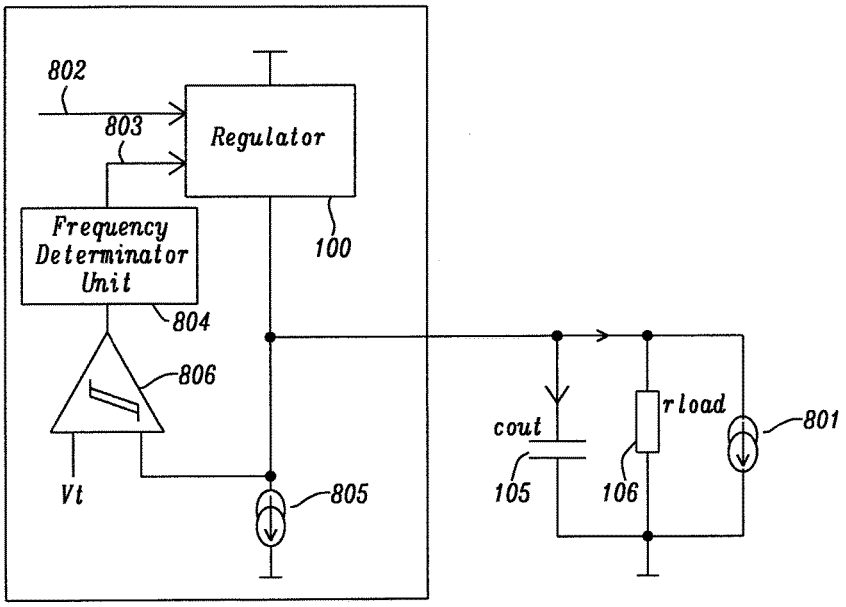
FIG. 8 illustrates an example scheme for measuring the output capacitor value.

FIG. 8 illustrates a further scheme for measuring the value 160 of an output capacitor 105. The gain of the regulator 100 may be manipulated using a gain control setting 802. When the gain of the regulator 100 is increased intentionally, the regulator 100 can be forced into instability. Once the regulator 100 is unstable, the frequency of oscillation of the output voltage 611 is a function of the value 160 of the output capacitor 105. Hence, the frequency 803 of oscillation may be determined using a frequency determination unit 804 and can be used to determine the output capacitor value 160 (e.g. using a formula or a look-up table).

Preferably, the regulator 100 is internally loaded with a relatively high current value in order to ensure that the regulator 100 is biased at a high current region with high energy oscillations that are easily detectable. The oscillation frequency can be post processed by turning the regulator 100 into a relaxation oscillator by means of a comparator 806 at the output node of the regulator (with the comparator 806 having sufficient bandwidth). By doing this low amplitude sinusoidal oscillations can be converted into rail to rail square wave information that can be used for digital post processing. A current source 805 for absorbing the load current (e.g. a known load current) may be provided at the input of comparator 806, which is coupled to the output port of the regulator 100.

In the present document, a regulator 100 has been described which may be configured to automatically adapt its operation to the measured value 160 of an output capacitor 105. By doing this, large tolerance output capacitor 105 may be used, thereby reducing the cost of a regulator 100. Furthermore, the range of output capacitor values 160 may be increased. In addition, internal power dissipation may be decreased.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A voltage regulator configured to provide an output current at an output voltage at an output node of the voltage regulator, based on an input voltage at an input node of the voltage regulator, wherein the voltage regulator comprises,
- an output amplification stage for deriving the output current at the output node from the input voltage at the input node in dependence of a drive voltage;
- a differential amplification stage configured to determine the drive voltage in dependence of the output voltage and in dependence of a reference voltage; and
- an adaption unit configured to
  - determine a capacitance indication of a capacitor value of an output capacitor coupled to the output node of the voltage regulator; and
  - adapt the differential amplification stage in dependence of the capacitance indication; and
  - adapt a quiescent current of the voltage regulator in dependence of the capacitance indication.

2. The voltage regulator of claim 1, wherein
- the voltage regulator comprises a current source configured to provide an output current at a first output current value to the output node;
- the voltage regulator comprises voltage sensing means configured to sense a voltage indication of a voltage across the output capacitor; and
- the adaption unit (200) is configured to determine the capacitance indication based on the first output current value (602) and the voltage indication.

3. The voltage regulator of claim 2, wherein the adaption unit is configured to
- determine, based on the voltage indication, a first duration required for charging the output capacitor from an initial voltage (V1) to a target voltage (V2) using the output current at the first output current value; and
- determine the capacitance indication based on the first duration.

4. The voltage regulator of claim 3, wherein
- the initial voltage (V1) and/or the target voltage (V2) are dependent on the reference voltage; and/or
- during operation, the output voltage of the linear regulator is regulated to a setpoint voltage, which is dependent on the reference voltage; and the initial voltage (V1) and/or the target voltage (V2) lie within a pre-determined range around the setpoint voltage; and the pre-determined range is e.g. 30% or less below to 30% or less above the setpoint voltage.

5. The voltage regulator of claim 3, wherein the voltage regulator comprises a discharge circuit configured to discharge the output capacitor; and the adaption unit is configured to instruct the discharge circuit to discharge the output capacitor, subject to the output capacitor being charged to the target voltage (V2).

6. The voltage regulator of claim 5, wherein the adaption unit is configured to control the current source to provide an output current at a second output current value to the output node; wherein the second output current value is different from the first output current value;

determine, based on the voltage indication, a second duration required for charging the output capacitor from the initial voltage (V1) to the target voltage (V2) using the output current at the second output current value; and determine the capacitance indication based on the second output current value and based on the second duration.

7. The voltage regulator of claim 6, wherein the adaption unit is configured to determine the capacitance indication based on $$(IOUT2-IOUT1)/(V2-V1)*[(D1*D2)/(D1-D2)]$$

wherein

IOUT1 is the first output current value;

IOUT2 is the second output current value;

V1 is the initial voltage;

V2 is the target voltage;

D1 is the first duration; and

D2 is the second duration.

8. A voltage regulator configured to provide an output current at an output voltage at an output node of the voltage regulator, based on an input voltage at an input node of the voltage regulator, wherein the voltage regulator comprises, an output amplification stage for deriving the output current at the output node from the input voltage at the input node in dependence of a drive voltage;

a differential amplification stage configured to determine the drive voltage in dependence of the output voltage and in dependence of a reference voltage; and an adaption unit configured to determine a capacitance indication of a capacitor value of an output capacitor coupled to the output node of the voltage regulator;

adapt the differential amplification stage in dependence of the capacitance indication;

adapt a gain of the voltage regulator to cause an oscillation of the output voltage of the voltage regulator;

determine a frequency indication of a frequency of the oscillation; and determine the capacitance indication based on the frequency indication.

9. The voltage regulator of claim 8, wherein the voltage regulator comprises a comparator configured to generate a binary signal based on a comparison of the oscillating output voltage and based on a threshold voltage (Vt); and the adaption unit is configured to determine the frequency indication based on the binary signal.

10. The voltage regulator of claim 1, wherein the differential amplification stage comprises one or more adjustable components affecting a bandwidth of the linear regulator;

the adaption unit is configured to adjust the one or more adjustable components in dependence of the capacitance indication.

11. The voltage regulator of claim 1, wherein the differential amplification stage comprises a Miller capacitor with an adjustable capacitance; and the adaption unit is configured to adjust the capacitance of the Miller capacitor in dependence of the capacitance indication.

12. The voltage regulator of claim 11, wherein the differential amplification stage comprises a first amplification stage configured to determine an intermediate voltage at an intermediate node in dependence of the output voltage and in dependence of the reference voltage;

the differential amplification stage comprises a second amplification stage configured to determine the drive voltage based on the intermediate voltage; and the Miller capacitor couples the output node to the intermediate node.

13. The voltage regulator of claim 1, wherein the adaption unit is configured to increase a bandwidth of the voltage regulator if the capacitance indication indicates a reduction of the capacitor value of the output capacitor; and/or decrease the bandwidth of the voltage regulator if the capacitance indication indicates an increase of the capacitor value of the output capacitor.

14. A method for operating a voltage regulator; wherein the voltage regulator provides an output current at an output voltage at an output node of the voltage regulator, based on an input voltage at an input node of the voltage regulator; wherein the voltage regulator comprises an output amplification stage for deriving the output current at the output node from the input voltage at the input node in dependence of a drive voltage; wherein the voltage regulator comprises a differential amplification stage to determine the drive voltage in dependence of the output voltage and in dependence of a reference voltage; wherein the method comprises the steps of:

determining a capacitance indication of a capacitor value of an output capacitor coupled to the output node of the voltage regulator;

adapting the differential amplification stage in dependence of the capacitance indication; and adapting a quiescent current of the voltage regulator in dependence of the capacitance indication.

15. The method of claim 14, wherein the voltage regulator comprises a current source to provide an output current at a first output current value to the output node;

the voltage regulator comprises voltage sensing means to sense a voltage indication of a voltage across the output capacitor; and the voltage regulator comprises an adaption unit to determine the capacitance indication based on the first output current value and the voltage indication.

16. The method of claim 15, further comprising the steps of:

determining, based on the voltage indication, a first duration required for charging the output capacitor from an initial voltage (V1) to a target voltage (V2) using the output current at the first output current value by the adaption unit; and determining the capacitance indication based on the first duration by the adaption unit.

17. The method of claim 16, wherein the initial voltage (V1) and/or the target voltage (V2) are dependent on the reference voltage; and/or during operation, the output voltage of the linear regulator is regulated to a setpoint voltage, which is dependent on the reference voltage; and the initial voltage (V1) and/or the target voltage (V2) lie within a pre-determined range around the setpoint voltage; and the pre-determined range is e.g. 30% or less below to 30% or less above the setpoint voltage.

18. The method of claim 16, wherein the voltage regulator comprises a discharge circuit to discharge the output capacitor; and the adaption unit instructs the discharge circuit to discharge the output capacitor, subject to the output capacitor being charged to the target voltage (V2).

19. The method of claim 18, further comprising the steps of:

controlling the current source to provide an output current at a second output current value to the output node; wherein the second output current value is different from the first output current value by the adaption unit;

determining, based on the voltage indication, a second duration required for charging the output capacitor from the initial voltage (V1) to the target voltage (V2) using the output current at the second output current value by the adaption unit; and determining the capacitance indication based on the second output current value and based on the second duration by the adaption unit.

20. The method of claim 19, wherein the adaption unit determines the capacitance indication based on $$(IOUT2-IOUT1)/(V2-V1)*[(D1*D2)/(D1-D2)]$$

wherein

IOUT1 is the first output current value;

IOUT2 is the second output current value;

V1 is the initial voltage;

V2 is the target voltage;

D1 is the first duration; and

D2 is the second duration.

21. The method of claim 14, further comprising the steps of:

adapting a gain of the voltage regulator to cause an oscillation of the output voltage of the voltage regulator by an adaption unit;

determining a frequency indication of a frequency of the oscillation by the adaption unit; and determining the capacitance indication based on the frequency indication by the adaption unit.

22. The method of claim 21, wherein the voltage regulator comprises a comparator to generate a binary signal based on a comparison of the oscillating output voltage and based on a threshold voltage (Vt); and the adaption unit determines the frequency indication based on the binary signal.

23. The method of claim 14, wherein the differential amplification stage comprises one or more adjustable components affecting a bandwidth of the linear regulator;

the voltage regulator comprises an adaption unit adjusting the one or more adjustable components in dependence of the capacitance indication.

24. The method of claim 14, wherein the differential amplification stage comprises a Miller capacitor with an adjustable capacitance; and the voltage regulator comprises an adaption unit adjusting the capacitance of the Miller capacitor in dependence of the capacitance indication.

25. The method of claim 24, wherein the differential amplification stage has a first amplification stage to determine an intermediate voltage at an intermediate node in dependence of the output voltage and in dependence of the reference voltage;

the differential amplification stage has a second amplification stage to determine the drive voltage based on the intermediate voltage; and the Miller capacitor couples the output node to the intermediate node.

26. The method of claim 14, wherein the voltage regulator comprises an adaption unit, and wherein the adaption unit:

increases a bandwidth of the voltage regulator if the capacitance indication indicates a reduction of the capacitor value of the output capacitor; and/or decreases the bandwidth of the voltage regulator if the capacitance indication indicates an increase of the capacitor value of the output capacitor.

* * * * *